US006323469B1

(12) United States Patent
Bissdorf et al.

(10) Patent No.: US 6,323,469 B1
(45) Date of Patent: Nov. 27, 2001

(54) INDUCTION HEATING OF METALS

(75) Inventors: Richard J. Bissdorf, Hirschhorn; Werner K. Harnisch, Unterdielbach, both of (DE)

(73) Assignee: G.H. Induction Deutschland Induktions-Erwaermungs-Anlagen GmbH, Hirschhorn (DE)

( * ) Notice: Subject to any disclaimer, the term of this patent is extended or adjusted under 35 U.S.C. 154(b) by 0 days.

(21) Appl. No.: 09/622,033

(22) PCT Filed: Jan. 23, 1999

(86) PCT No.: PCT/EP99/00442

§ 371 Date: Oct. 5, 2000

§ 102(e) Date: Oct. 5, 2000

(87) PCT Pub. No.: WO99/43187

PCT Pub. Date: Aug. 26, 1999

(30) Foreign Application Priority Data

Feb. 20, 1998 (DE) ..... 198 07 099

(51) Int. Cl.[7] ..... H05B 6/42

(52) U.S. Cl. ..... 219/677; 219/632; 219/676; 336/62; 336/65; 336/195

(58) Field of Search ..... 219/672, 674, 219/676, 677, 632; 336/60, 62, 65, 68, 90, 195

(56) References Cited

U.S. PATENT DOCUMENTS

| | | | | |
|---|---|---|---|---|
| 4,119,825 | * | 10/1978 | Taylor et al. | 219/677 |
| 4,590,347 | * | 5/1986 | Thatcher et al. | 219/676 |
| 4,668,850 | * | 5/1987 | Matsuda et al. | 219/767 |
| 5,391,863 | * | 2/1995 | Schmidt | 219/677 |
| 5,430,274 | * | 7/1995 | Couffet et al. | 219/677 |

FOREIGN PATENT DOCUMENTS

| | | |
|---|---|---|
| 523 823 | 4/1931 | (DE) . |
| 17 33 800 | 11/1956 | (DE) . |
| 24 02 851 | 7/1975 | (DE) . |
| 195 04 742 | 8/1996 | (DE) . |
| 0 774 816 | 5/1997 | (EP) . |
| 0 789 438 | 8/1997 | (EP) . |
| 0 804 050 | 10/1997 | (EP) . |
| 1 390 138 | 6/1965 | (FR) . |
| 2 122 057 | 1/1984 | (GB) . |
| WO 95 25417 | 9/1995 | (WO) . |

OTHER PUBLICATIONS

RWE Energie "Induktive Erwarmung" [Induction Heating], pp. 42–43, (1991).

Soviet Patents Abstracts, Week 9237, Derwent Publications Ltd., London, GB; AN 92–306470 XP002104290 & SU 1 684 940 A (Tractor Agric Equip Prodn Assoc), Oct. 15, 1991.

* cited by examiner

*Primary Examiner*—Philip H. Leung
(74) *Attorney, Agent, or Firm*—Foley & Lardner

(57) ABSTRACT

A fluid cooled electric conductor for induction heating of a workpiece includes a flexible conductor which is enclosed within an insulating tube. The conductor is supported within the tube so as to be surrounded by a fluid conducting space or spaces. A support arrangement supports the tube. Temperature sensors adjust the heating process by, for example, operating variable-length holders that support the tube in a spaced relationship with a workpiece.

23 Claims, 4 Drawing Sheets

INDUCTION HEATING OF METALS

The present invention relates to the field of the induction heating of workpieces, in particular a shaping and clamping system for a flexible inductor.

Induction heating, of metals in particular, is familiar in many applications, such as the adhesive bonding of bodywork parts, and the curing and tempering of workpieces. Conventional inductors comprise water-cooled, rigid copper tubes which are fixed close to the workpiece in holders. Since the heating of the workpiece depends exponentially on the distance between the inductor and the workpiece surface, a dedicated inductor has to be created for each workpiece shape, to which corrections are impossible or possible only with difficulty.

A flexible induction device is known from RWE Energie "Induktive Erwärmung" [Induction Heating] (1991). In this case, in order to fix the distance from a turbine rotor, the latter is initially provided with an insulating layer, and a flexible cable laid loosely in a tube is wound around the turbine rotor, and the said cable is cooled with water during heating of the rotor by the eddy current which builds up in the cable, in order to protect the inductor from the heat conduction which is present in spite of the insulation. In this case, the distance of the flexible cable is defined by the insulating winding applied to the turbine rotor, the tube wall thickness, which is in the centimeter range here, and the irregular position of the electric conductor in the tube. In the known system, in which the product to be heated forms the inductor shape, the distance between the electric conductor and the surface of the workpiece can be set only in the centimeter range, and therefore the thermal efficiency of induction heating is relatively low.

A further significant disadvantage is that the workpiece to be heated can be heated only when at a standstill, as a result of the geometric coupling with the induction system. This circumstance always leads to extensive coil systems, whose impedance matching is very long-winded.

In addition, the distance between the electric conductor in the tube and the surface of the workpiece varies by up to more than ±1 cm over the circumferential length. Water cooling is carried out only at the surface of the electric conductor, and the remaining water channel permits only low flow rates in its cross section, so that only low current densities in the frequency range up to a maximum of 4 kHz can be used.

DE-U 17 33 800 discloses a cooled electric conductor for the induction heating of workpieces, which can be fixed in contact with the wall of a tube; likewise GB 2 122 057 discloses a (non-flexible) inductor whose individual segments can be fixed in variable positions via holders.

Further prior art which should be mentioned is EP 0 789 438 A2, DE 195 04 742 A1 and EP 0 774 816 A2. In each case, the disadvantage is that defined distances between the inductor and the workpiece, and therefore the targeted input of power, are not possible.

The SU-A1 684 940 ultimately shows a flexible water-cooled conductor, but leaves open (omits) how the conductor is kept free from its wall/partition.

The present invention has therefore been based on the object of providing a flexible inductor in which, although the distances to the surface of the workpiece can be maintained exactly, these can be varied in a very simple way in order, by this means, either to reproduce contours or to produce temperature profiles in the workpiece and also to be able to vary them during the heating, as well as to provide more favorable cooling conditions for the electric conductor, in order to be able to operate at current densities up to 180 $A/mm^2$ and frequencies up to 200 kHz with one and the same conductor system.

According to the invention, this object is achieved with a liquid-cooled or gas-cooled electric conductor for the induction heating of workpieces, comprising a flexible conductor and an electrically insulating tube which surrounds said conductor at a distance, in that the conductor is fixed in the tube so as to be axially parallel and away from the wall of said tube, and can be fixed in variable positions with respect to the workpiece via holders which are separate from one another.

The fact that the conductor is fixed in position within the tube results in significant advantages. On the one hand, constant volume relationships for the flow of the liquid cooling medium are provided, that is to say the heat transport is constant over the length of the inductor. On the other hand, the tube can be bent, it is therefore possible for contours to be reproduced very easily, the holders defining said contours in relation to the workpiece and at a desired distance, so that prescribed temperatures can be maintained very exactly and can also be varied easily.

The flexible conductor is preferably a stranded copper conductor, and it can be fixed in position in the tube via, for example, broken rings pushed onto the conductor or by pins pushed into the tube and welded or adhesively bonded. The tube particularly preferably has internal profiled sections which hold the line [sic] firmly, either coaxially or else parallel to the sides.

The tube itself can have a round cross section or else, if required, an angular, for example square, cross section.

The tube itself is preferably fabric reinforced, in order to keep the wall thickness (≦3 mm) low even at relatively high coolant pressures, which has a positive effect on the dissipation of the heat radiated back from the workpiece. At the same time, the efficiency is of course also increased by the more effective cooling.

The invention further proposes to use, as the conductor, a tube-like hollow stranded conductor, this providing the possibility of applying coolant to the interior of the conductor as well, so that heat can be dissipated from the channel between the outer of the tube and the stranded conductor to the inner cooling medium as well, in order in this way to increase the electrical efficiency further.

For this purpose, the hollow stranded conductor advantageously has in its interior installed fittings which support the tube profile and which of course likewise have to be flexible, for example comprising independent parts that are separate from one another.

It is also proposed to stiffen the inductor with the aid of the cooling medium (water, gas), for which purpose a pressure of about 3–10 bar is maintained in the interior of the tube, the coolant flowing at a speed of, for example, about 2–10 m/sec.

According to the invention, the distance between the inductor and the workpiece is fixed via clamps which surround the tube and are open toward the workpiece and into which the tube can be inserted at any desired point. The distances between the clamps can in principle be selected freely. The clamps are connected to holders, whose position and length are designed to be variable, in order to be able to shape desired contours of the workpiece or the desired heat profile to be produced.

The fact that the inductor is flexible of course means that the set position of the inductor can itself be varied easily even during heating. This opens up the possibility of controlling the position of the clamps via a temperature measurement, in order to withdraw said clamps, for example after a desired value has been reached, for example in order as a result to keep said temperature constant following rapid heating.

This can also be used for automatic control, the clamps in each case being assigned temperature sensors, whose measured value is used to control the setting of the distance of the inductor with the aid of spindle drives.

A particularly elegant fixing of the current-carrying conductor is achieved with a helix, preferably consisting of a plastic filament, which rests on the inner surface of the tube, the cooling medium being led spirally around the conductor. In this case, the helix can be wound around the stranded conductor, but it can also be produced as an internal profile of the tube or can be pushed into the tube as a separate part before the mounting of the conductor.

Finally, a novel coolant flow connection for inductors having a hollow stranded conductor is proposed. This connection comprises a metal nipple having a connecting spigot which has a longitudinal bore for the coolant feedline and, on its head, bears a union nut as screw fixing. At its free end, the spigot has an annular groove, into which the hollow stranded conductor is inserted and in which it is fixed, for example by soldering or crimping. The flow connection is in this case made via the free metal parts of the nipple, through which coolant flows in its interior, and which is therefore likewise protected against excessive heating.

The present invention will be explained with reference to the appended figures, in which.

Figure 1:
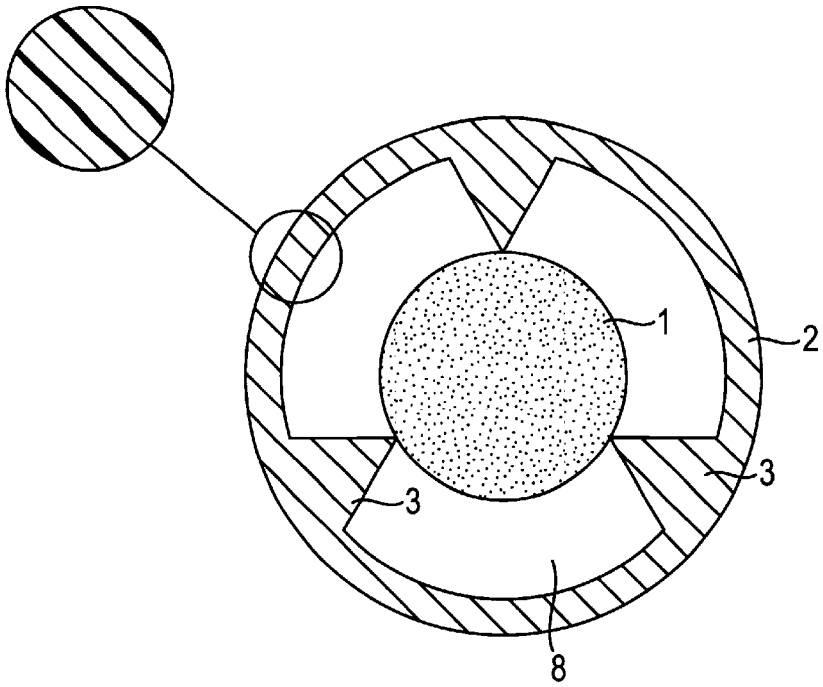
FIG. 1 shows a cross section through an inductor with a central arrangement of the conductor.

FIG. 1 shows a tube 2 made of, in particular, fabric-reinforced plastic, in the interior of which the flexible conductor 1 is laid coaxially. The latter consists in the present case of a stranded conductor, whose diameter is matched to the intended use. The wall thickness of the tube is in this case about 1 to 2 mm.

In its interior, the tube is provided with profiled sections 3, which fix the conductor 1 spatially in relation to the wall, so that displacing the tube 2 toward or away from a workpiece moves the conductor to exactly the same extent, and thus precise adjustments are made possible. In this context, it should be pointed out that the heating behaves exponentially (quadratically) with the distance of the conductor 1 from the workpiece, so that relatively small distance errors have a relatively considerable effect. The distance of the wall of the tube from the workpiece is typically about 2 mm.

Located in the interior of the tube 2 are ducts 8 through which cooling water flows, it being possible for the ducts 8 also to communicate with one another. The cooling means that it is possible, with the small workpiece spacing previously mentioned, to produce temperatures up to more than 800° C. without additional insulation without destroying the tube material. In this case, a flow velocity of about 15 m/sec is maintained in the tube. Since water flows around the conductor 1, this type of workpiece heating can therefore also be used in applications with an explosion hazard.

Figure 3:
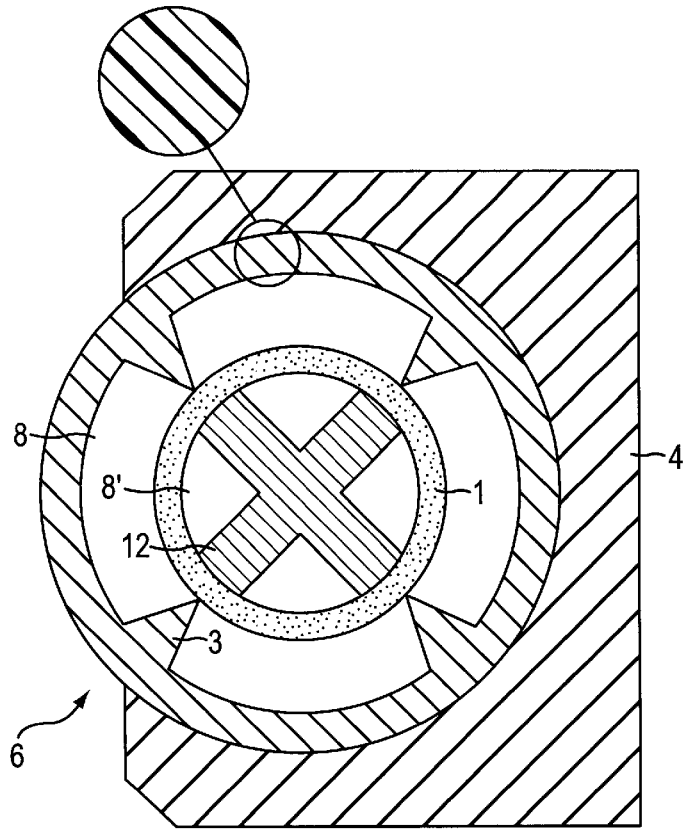
FIG. 3 shows an inductor with a hollow conductor.
Figure 4:
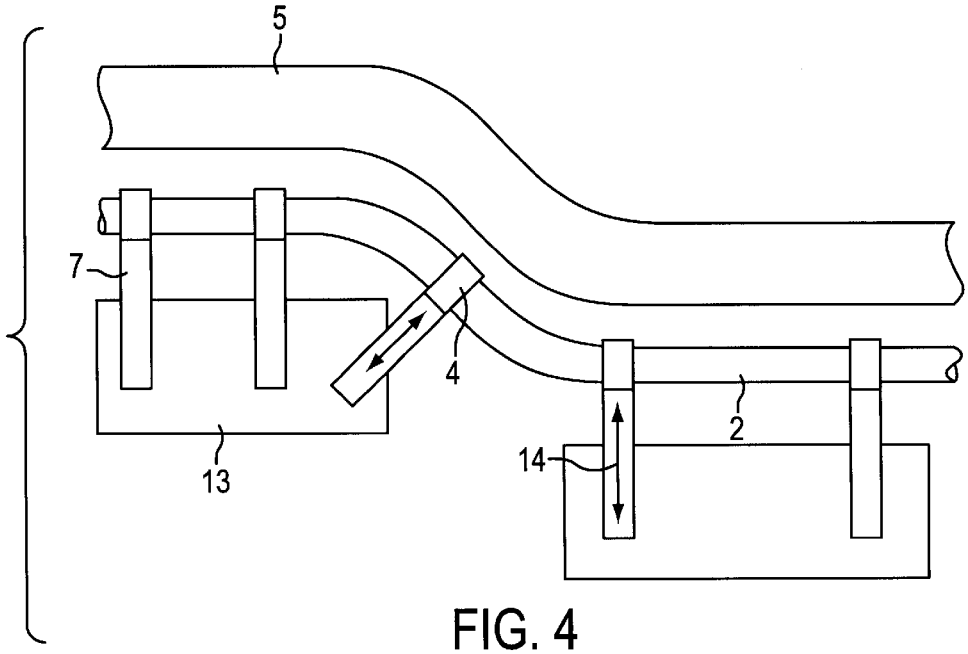
FIG. 4 shows an application example.

The water pressure may be 3 to 10 bar; a high water pressure has the desired effect of stiffening the tube considerably, so that under pressure it is given the characteristics of conventional copper lines through which water flows, and can therefore be positioned very accurately even when there is a relatively large distance between the holders (FIGS. 3, 4).

Figure 2:
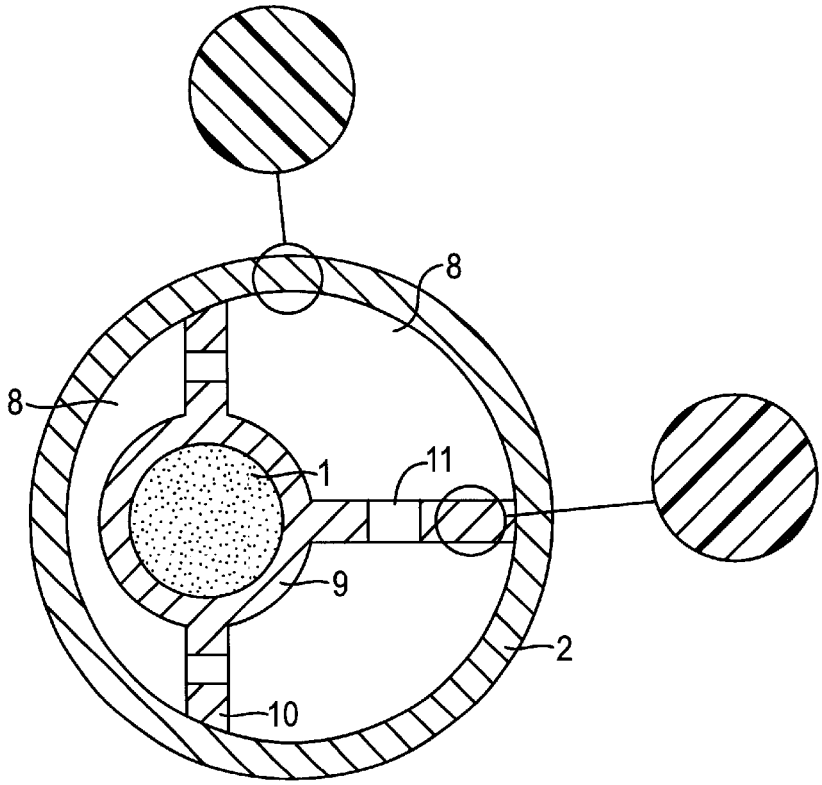
FIG. 2 shows such an inductor with a laterally offset conductor.

FIG. 2 shows a variant in which, firstly, the conductor 1 is offset (toward the workpiece). Secondly, the conductor 1 is located in a pipe 9 which has spacers 10. The latter may have drilled holes 11, via which the ducts 8 are connected to one another to improve the transport of heat. Of course, in addition to being round, the tubes 2 can also be configured in any other desired shapes, such as for example with a square cross section, but this is more likely to be considered at low water pressures.

FIG. 3 shows a particularly preferred variant of the present invention, in which the conductor 1 is a hollow stranded conductor like a tube. In the present case, this is centered by means of the profiled sections 3 and, in its interior, is stabilized by a cross profile 12, which likewise forms ducts 8' for carrying the cooling water. Since (stranded) copper is a good conductor of heat, and the meshes of the stranded conductor are likewise flooded, in this case the cooling of the tube is particularly good, and a very high workpiece temperature is therefore possible.

In addition, this figure shows the possible fastening of the tube to any desired supporting constructions. In this case, the tube 2 is located in a clamp 4, which encloses the tube 2 over an angle greater than 180° and thus clamps it in. Since, when the inductor is mounted, there is no water pressure in the line, the action of clamping the tube into the clamps 4 is very simple, and, after the water pressure has been applied, the tube 2 can be released only with difficulty or by applying great force. The clamps have an opening 6 which is oriented toward the workpiece and is dimensioned such that the ability of the clamps 4 to hold is not impaired by excessively high temperatures, said clamps of course also being cooled via the tube 2.

FIG. 4 shows a typical application on a curved workpiece, such as in the case of motor vehicle fitted parts, such as doors or flaps, where the outer and inner sheet metal has to be heated all round or in segments for adhesive bonding. With the flexible inductor tube 2, a curved contour can be reproduces easily, the tube 2 resting in the clamps 4, which themselves are in turn connected via holders 7 to carrying plates 13. The holders 7 have longitudinal adjusting means 14; the height of the plates 13 can be set. The temperature of the workpiece can be determined via temperature sensors, and the distance from the workpiece 5 can subsequently be controlled, in order to be able to set the temperature exactly.

Figure 5:
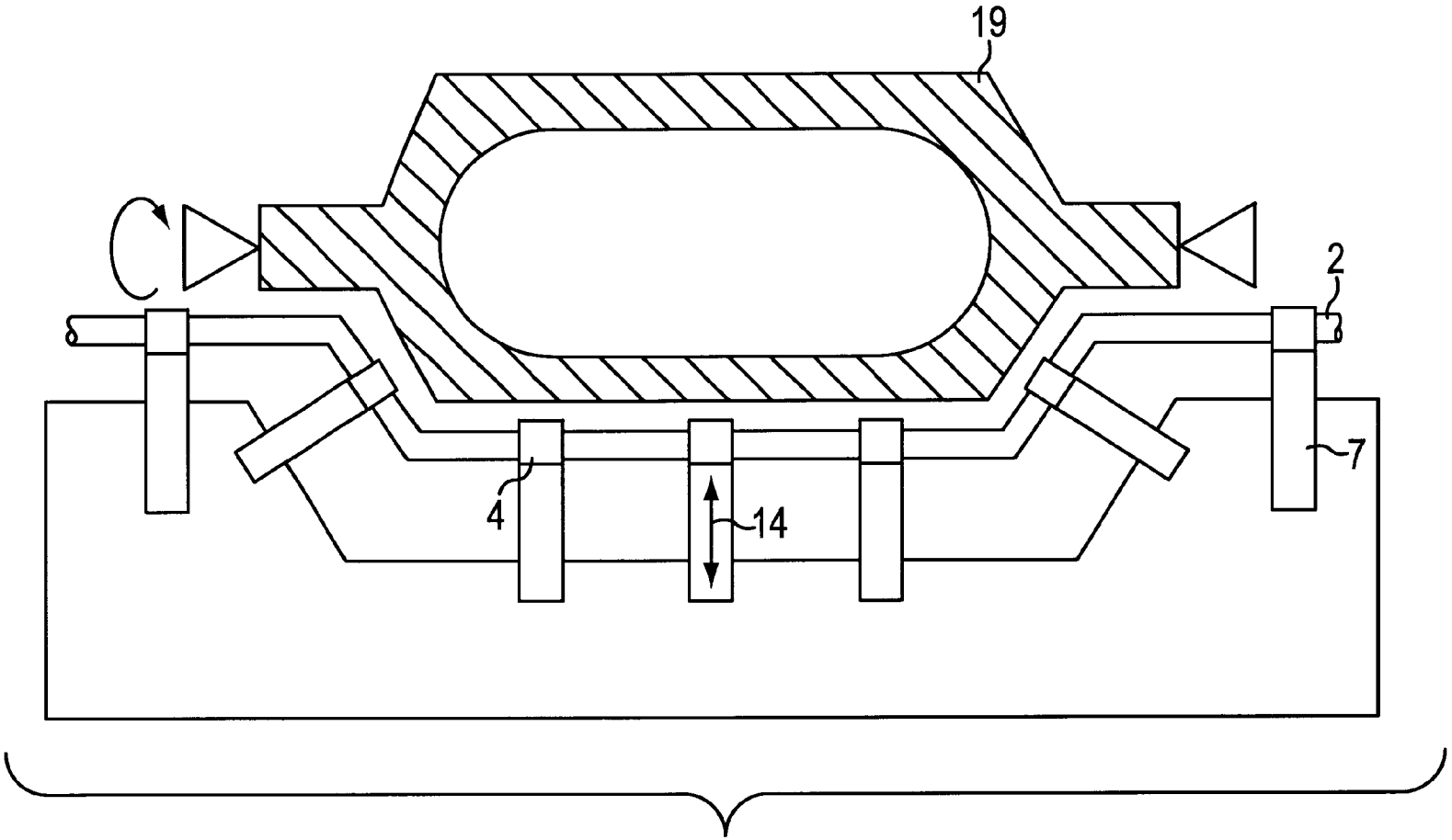
FIG. 5 shows a further application example.

FIG. 5 shows an application in which a roll 19 (or a hollow shaft) is heated while rotating. Said roll has a very different mass distribution and geometry over the length. The flexible inductor tube 2 is brought at a distance, with the aid of clamps 4 and the holders 7 and the adjusting means 14, or in this regard is corrected during the heating, in such a way that the distances correlate with the mass segments located opposite them, so that an identical temperature gradient is achieved over the entire component width of the workpiece.

Figure 6:
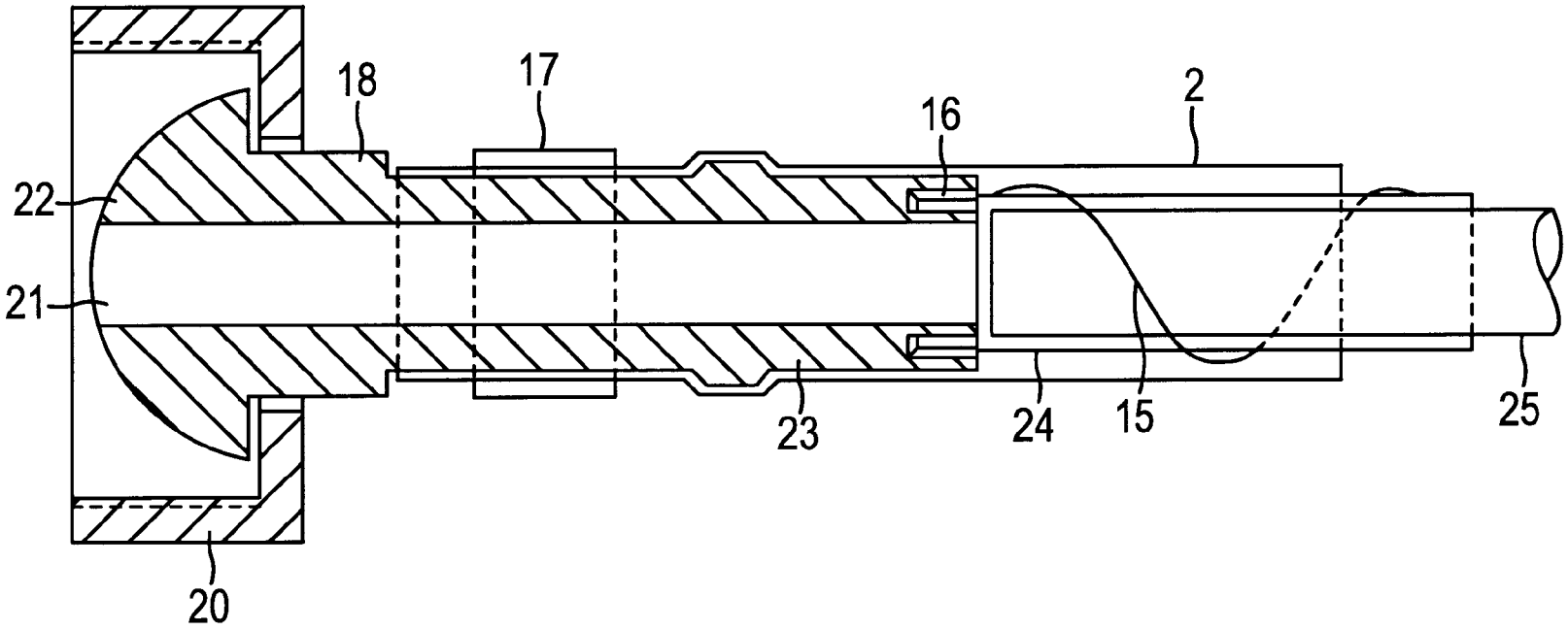
FIG. 6 shows the connection of a hollow conductor to the cooling medium.

FIG. 6 shows a connecting nipple 18 for connecting the inductor tube 2 to the coolant (liquid, gas). Said nipple consists of metal (copper) and has, in its interior, a longitudinal bore 21, via which the cooling medium is led in. On its head 22, said nipple bears a union nut 20. The tube 2 is pushed over the connecting spigot 23 and secured with a hose clip 17.

At its front end, the connecting spigot 23 has an annular groove 16, into which the hollow stranded conductor 24 is inserted and crimped or soldered.

In its interior, the hollow stranded conductor 24 is stabilized by a supporting element 25, for example a cross profile (12, FIG. 3), and is surrounded at the periphery by a helix 15 consisting of a plastic filament, which serves as a spacer with respect to the inner surface of the tube 2. The cooling medium therefore flows around the hollow conductor 24 spirally, so that said medium is led continuously from the warm side, facing the workpiece, to the opposite cold side. By this means, an essentially vortex-free flow of the cooling medium is achieved with the maximum cross section (without backflow).

Electrical contact can be made via the nipple 18 over a relatively short distance, and ensures great flexibility of the power/water connection.

List of Reference Symbols

1 Conductor
2 Tube
3 Profiled sections
4 Clamps
5 Workpiece
6 Opening
7 Holder
8, 8' Ducts
9 Pipe
10 Spacers
11 Drilled holes
12 Cross profile
13 Carrying plates
14 Longitudinal adjusting means
15 Plastic filament
16 Annular groove
17 Hose clip
18 Connecting nipple
19 Roll or hollow shaft
20 Union nut
21 Longitudinal bore
22 Head
23 Connecting spigot
24 Hollow stranded conductor
25 Supporting element

What is claimed is:

1. A fluid cooled electric conductor for induction heating of a work piece comprising:

a tube made of electrically insulating material;

a flexible conductor disposed within the tube so that an external periphery of the flexible conductor is completely separated from an inner surface of the tube and so that an essentially annular fluid passage is defined about the flexible conductor; and at least one radially inwardly extending projection which is unitary with the tube and extends from the inner wall of the tube, which supports the flexible conductor in its separated condition with respect to the inner periphery of the tube, and which permits fluid to enclose the flexible conductor.

2. A fluid cooled electric conductor according to claim 1, wherein the at least one inwardly extending projection comprises a profiled section of the tube which is oriented inward toward the flexible conductor.

3. A fluid cooled electric conductor according to claim 1, wherein the tube comprises a fabric-reinforced plastic tube.

4. A fluid cooled electric conductor according to claim 1, wherein the electric conductor is a hollow stranded conductor.

5. A fluid cooled electric conductor according to claim 4, wherein the hollow stranded conductor has a flexible support in an interior thereof.

6. A fluid cooled electric conductor according to claim 4, wherein at least one end of the tube is drawn over a connecting spigot which has a longitudinal bore, and wherein the spigot is connected to the hollow stranded conductor.

7. A fluid cooled electric conductor according to claim 6, wherein the hollow stranded conductor is held in an annular groove formed in the connecting spigot.

8. A fluid cooled electric conductor according to claim 6, wherein the spigot has a nipple head which bears against a union nut.

9. A fluid cooled electric conductor according to claim 1, wherein the tube is adapted to receive water under a pressure of 10–30 bar.

10. A fluid cooled electric conductor according to claim 1, further comprising clamps adapted to support the tube in an operative position with respect to the workpiece, the clamps having openings which are adapted to be oriented toward the work piece to be heated and which expose a portion of the tube to the workpiece to be heated.

11. A fluid cooled electric conductor according to claim 10, wherein the clamps are fastened to variable-length holders.

12. A fluid cooled electric conductor according to claim 11, wherein the holders have drive mechanisms for adjusting the length thereof.

13. A fluid cooled electric conductor according to claim 10, further comprising temperature sensors which are disposed with the clamps, and wherein the distance between the tube and the workpiece is controlled by adjusting the variable-length holders on the basis of temperature measured by the temperature sensors.

14. A fluid cooled electric conductor according claim 1, wherein the at least one inwardly extending projection comprises a helix which surrounds and locates the flexible conductor inside the tube.

15. A fluid cooled electric conductor for induction heating of a work piece comprising:

a tube;

a flexible conductor disposed within the tube so that the external periphery of the flexible conductor is completely separated from an inner surface of the tube and so that an essentially annular fluid passage is defined about the flexible conductor;

at least one projection which extends inwardly from the inner wall of the tube, which supports the flexible conductor in its separated condition with respect to the inner periphery of the tube, and which permits fluid to enclose the flexible conductor; and at least one sensor disposed with the tube for controlling the heating of the work piece.

16. A fluid cooled electric conductor according to claim 15, wherein the at least one sensor is operatively connected with a support arrangement which supports the tube with respect to a work piece and controls operation of the support arrangement.

17. A fluid cooled electric conductor according to claim 15, wherein the at least one sensor is a temperature sensor.

18. A fluid cooled electric conductor according to claim 15, wherein the support arrangement includes at least one clamp which partially encloses the tube and which orients a portion of the tube, which is un-enclosed by at least one clamp, toward the work piece.

19. A fluid cooled electric conductor according to claim 15, wherein the flexible conductor is hollow and is connected to at least one end to a connection spigot so that fluid under pressure can be introduced into an interior of the hollow portion of the flexible conductor.

20. A fluid cooled electric conductor for induction heating of a work piece comprising:

a tube made of electrically insulating material;

a flexible conductor disposed within the tube so that a fluid passage is defined about the flexible conductor;

at least one radially inwardly extending projection which extends from the inner wall of the tube, which supports the flexible conductor in its separated condition with respect to the inner periphery of the tube, and which permits fluid to enclose the flexible conductor;

clamps adapted to support the tube in an operative position with respect to a workpiece, the clamps having openings which are adapted to be oriented toward the work piece to be heated and which expose a portion of the tube to the workpiece to be heated;

variable-length holders connected with the clamps; and temperature sensors which are disposed with the clamps, and wherein the distance between the tube and the workpiece is controlled by adjusting the variable-length holders on the basis of temperature measured by the temperature sensors.

21. A fluid cooled electric conductor for induction heating of a work piece comprising:

an elongate, electrically insulating tube having an essentially circular cross-section and a longitudinal axis;

a flexible conductor disposed within the tube so that the external periphery of the flexible conductor is completely separated from an inner surface of the tube and so that an essentially annular fluid passage is defined about the flexible conductor; and a plurality of spacers which extend inwardly from the inner wall of the tube, which supports the flexible conductor in its separated condition with respect to the inner periphery of the tube, and which permits fluid to enclose the flexible conductor, the spacers being so dimensioned and arranged so that the flexible conductor is supported in a position within the elongate tube which is eccentric with respect to the longitudinal axis.

22. A fluid cooled electric conductor according to claim 21, wherein the spacers are perforate to permit fluid to flow therethrough.

23. A fluid cooled electric conductor according to claim 21, wherein the flexible conductor is encased in a pipe which is integral with the plurality of spacers.

* * * * *